United States Patent [19]

Boyce

[11] 4,056,087

[45] Nov. 1, 1977

[54] TWO-FUEL CARBURETOR

[75] Inventor: Leonard D. Boyce, Kirkwood, Mo.

[73] Assignee: F. Travers Burgess, Kirkwood, Mo.

[21] Appl. No.: 670,718

[22] Filed: Mar. 26, 1976

[51] Int. Cl.[2] ..... F02M 13/04; F02M 31/00

[52] U.S. Cl. ..... 123/127; 123/25 K; 123/122 D; 123/198 A; 261/18 R; 261/18 A

[58] Field of Search ..... 123/127, 25 K, 25 R, 123/198 A, 122 D, 122 R; 261/18 R, 18 A

[56] References Cited

U.S. PATENT DOCUMENTS

| | | | |
|---|---|---|---|
| 1,865,514 | 7/1932 | Godard | 123/122 D |
| 2,444,179 | 6/1948 | Anderson | 123/25 K |
| 2,518,657 | 8/1950 | Boyce | 261/18 R |
| 2,611,592 | 9/1952 | Anderson | 261/18 A |
| 2,611,593 | 9/1952 | Boyce | 261/18 A |
| 2,621,029 | 12/1952 | Moseley | 261/18 A |
| 2,681,212 | 6/1954 | Fenley | 261/18 A |

FOREIGN PATENT DOCUMENTS

| | | | |
|---|---|---|---|
| 629,064 | 7/1927 | France | 123/122 D |
| 814,076 | 9/1951 | Germany | 123/122 D |
| 163,993 | 11/1933 | Switzerland | 123/122 D |

*Primary Examiner*—Wendell E. Burns
*Attorney, Agent, or Firm*—F. Travers Burgess

[57] ABSTRACT

An internal combustion engine carburetor is provided with means for introducing two separate types of liquid into the engine, one of the liquids being gasoline and the other a non-gasoline liquid, such as methyl alcohol, tertiary butyl alcohol, or other alcohols. The carburetor maintains the two liquids separate prior to their introduction into the Venturi to avoid problems normally incurred in blending other liquids with gasoline in liquid form and is constructed to prevent introduction of the non-gasoline liquid during normal idling and starting conditions and to introduce it in metered quantities during normal operation. To ensure vaporization of the two liquids in the primary Venturi, hot air at a temperature at least as high as the end point of the gasoline is introduced directly into the primary Venturi.

10 Claims, 9 Drawing Figures

TWO-FUEL CARBURETOR

BACKGROUND OF THE INVENTION

1. Field of the Invention

The invention relates to internal combustion engines and consists particularly in a novel carburetor construction for supplying two liquids, such as gasoline and a non-gasoline substance such a methanol, water or the like, to the engine.

2. The Prior Art

In the prior art, means for introducing two liquids, such as gasoline and some other substance to an engine, have usually required blending of the liquids prior to introduction to the engine. Such blending, for example, of methanol and gasoline, lowers the boiling point of the gasoline and thereby causes vapor lock in the fuel pump at lower temperatures than would be the case with gasoline by itself. Other types of liquid substances cannot be satisfactorily mixed with gasoline. Examples in the prior art of carburetors arranged to introduce a hydrocarbon fuel such as gasoline and another liquid substance into an engine have attempted to blend the gasoline and other liquid substances as liquids, as described in my U.S. Pat. Nos. 2,518,657 and 2,611,593. None has introduced the separate liquids individually into the primary Venturi and there vaporized them and blended the vapors. None of the prior art of which I am aware provides for idling and starting solely on gasoline, with the other liquid substance introduced automatically only under normal operating conditions.

SUMMARY OF THE INVENTION

The invention provides means for reducing the gasoline consumption of an internal combustion engine by automatically introducing into the engine only under normal operating conditions another liquid substance.

The invention provides means for automatically preventing introduction of the other liquid substance into the engine under normal idling and starting conditions.

The invention provides means incorporated in a carburetor for introduction of the gasoline and another liquid substance into the carburetor mixture conduit at a level above the fuel level in the carburetor float bowls and thereby avoids difficulties resulting from attempts to blend the two liquid substances as liquids.

To facilitate mixing of the two liquid substances in the Venturi of the carburetor mixture conduit, very hot air is introduced into the mixture conduit from a heat exchanger in the exhaust manifold.

In order to introduce only gasoline during idling and cold starting the idle system communicates only with the gasoline chamber, and, means responsive to closure of the choke valve is provided for shutting off the supply of the non-gasoline liquid to the mixture conduit when the choke valve is closed.

DETAILED DESCRIPTION OF THE INVENTION

Figure 1:
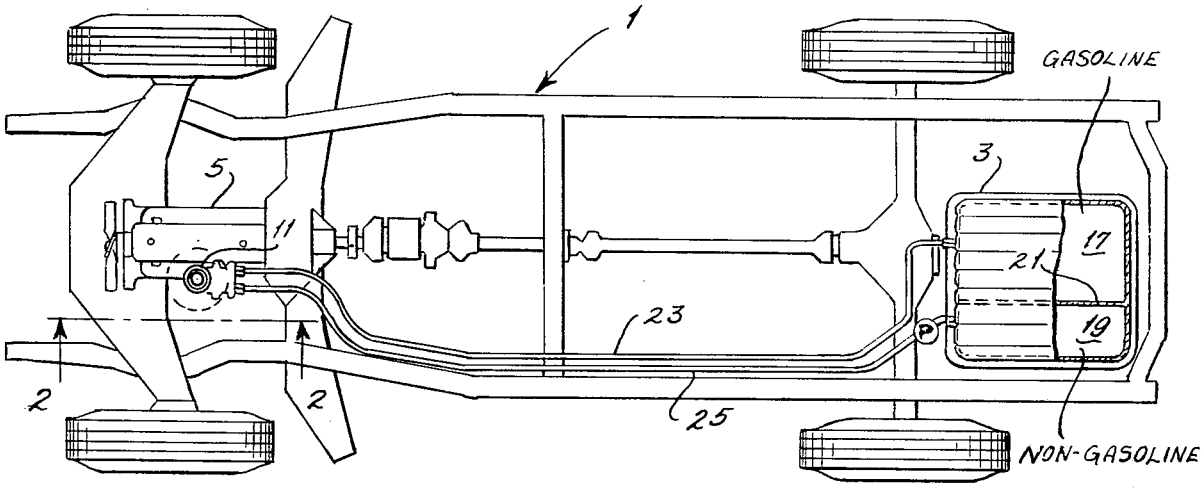
FIG. 1 is a plan view of an automobile chassis and propulsion system incorporating the invention.
Figure 2:
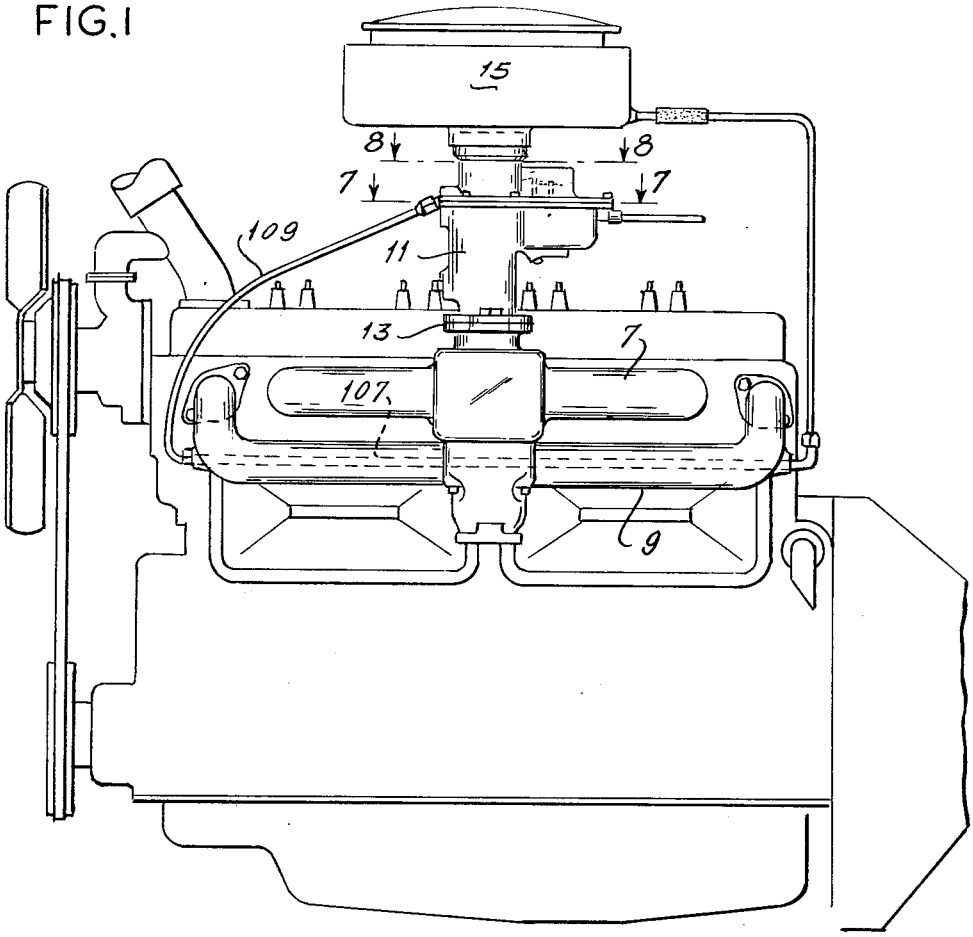
FIG. 2 is a side elevational view of an engine with a carburetor and air cleaner embodying the invention.
Figure 3:
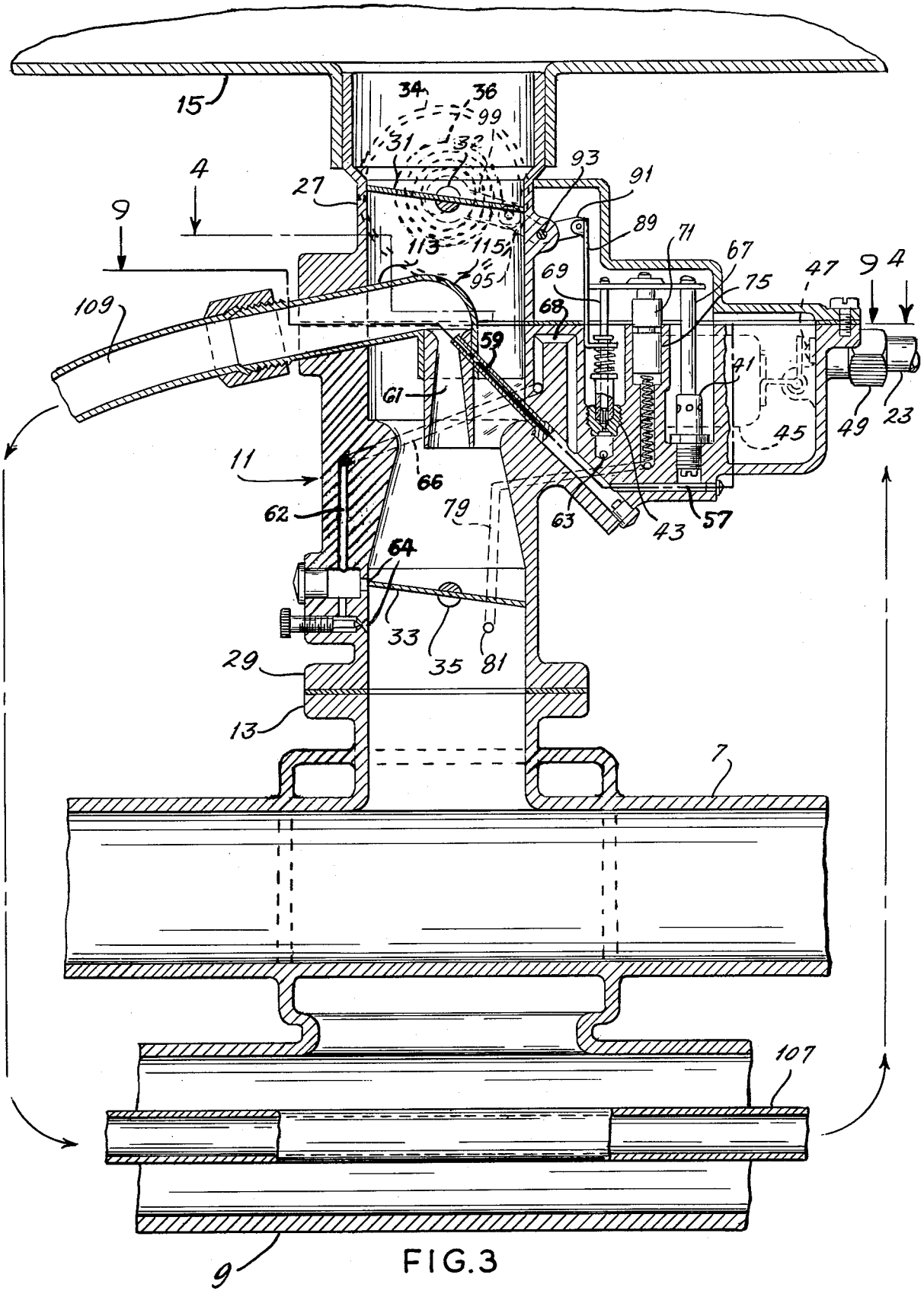
FIG. 3 is an enlarged composite vertical sectional view of the carburetor and adjacent portions of the air cleaner and engine manifold structure taken principally along line 3—3 of FIG. 7.
Figure 4:
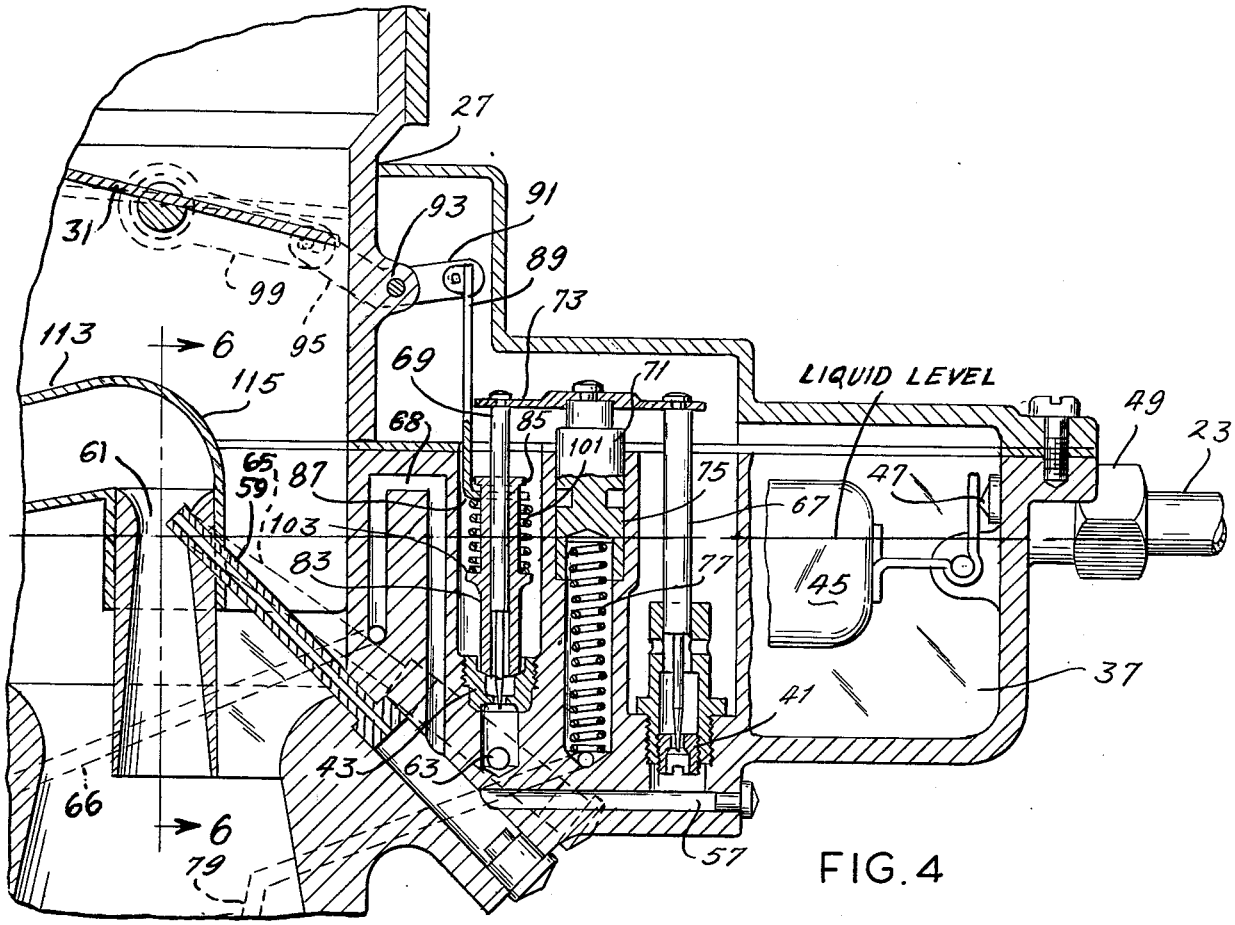
FIG. 4 is an enlarged fragmentary vertical sectional view of a portion of FIG. 3, but showing the relative positions of the elements when the choke valve is closed.

The numeral 1 generally indicates the chassis of an automobile having a two compartment fuel tank 3 at its rear end and an engine 5 at its front end. Engine 5 is formed with the usual intake manifold 7 and exhaust manifold 9 and a carburetor 11 is suitably secured to a flange 13 on intake manifold 7. The usual carburetor air cleaner 15 is mounted on top of the carburetor. Fuel tank 3 is divided into two compartments 17 for gasoline and 19 for a non-gasoline liquid separated by partition 21, compartment 17 being the larger of the two, and a pair of fuel lines 23 and 25 respectively lead from compartments 17 and 19 to carburetor 11.

As best seen in FIGS. 3–8, carburetor 11 has the usual upright intake conduit 27 formed with a flange 29 at its lower end for attachment to flange 13 on intake manifold 7. Intake conduit 27 has an air inlet at its upper end controlled by a choke valve 31 mounted on a transverse shaft 32 journaled in the wall of intake conduit 27 and a fuel outlet at its lower end controlled by a throttle valve 33 mounted on a shaft 35 also journaled in the wall of mixture conduit 27. Choke valve 31 may be controlled for cold starting and warm-up by the usual automatic choke mechanism 34 incorporating bi-metallic thermostatic coil 36 connected to choke shaft 32. Adjacent the intake conduit are a pair of constant level liquid chambers 37 and 39 having outlet metering orifice elements 41 and 43, respectively. A float 45 in chamber 37 operates a needle valve 47 controlling liquid inlet 49 connected to fuel line 23 in a manner to maintain a substantially constant liquid level in chamber 37.

Chamber 37 is intended to contain gasoline and chamber 39 is intended to contain a liquid other than gasoline, preferably methanol but possibly other non-gasoline, liquids, such as ethyl, alcohol, tertiary butyl alcohol or other alcohols.

A float 51 in chamber 39 controls needle valve 53 in fluid inlet 55 connected to fuel line 25 in a manner, similarly, to maintain a constant level of liquid. Orifice element 41 in chamber 37 is constantly open and communicates by means of a passage 57 with nozzle 59, which opens into intake conduit 27 adjacent the throat of primary Venturi 61.

Idling ports 64 in intake conduit 27 adjacent and posterior to throttle valve 33 when the latter is closed are connected by passages 62, 66 and 68 to the base of gasoline nozzle 59 and therefrom by passage 57 and constantly open orifice element 41 to gasoline chamber 37 so as to provide constant communication between the idling ports and gasoline chamber 37. As will be evident from the drawings, no communication is provided between the idling ports and non-gasoline liquid chamber 39.

Similarly orifice element 43 communicates via passage 63 with a second nozzle 65 which opens into the intake conduit at the throat of the primary Venturi 61 therein. Orifice elements 41 and 43 are controlled, respectively, by metering pins 67 and 69 having tapered or stepped lower ends adapted to extend into but not completely block the orifices in elements 41 and 43 respectively. These metering pins are carried and operated by a suction controlled plunger 71 having a cross bar 73 secured directly to metering pins 67 and 69.

Plunger 71 operates in a cylinder 75 and is constantly biased upwardly therein to open the metering pins by a spring 77. A suction passage 79 connects cylinder 75 with the outlet portion of the intake conduit below the throttle valve via a port 81.

In order to provide for cold starting as well as normal idling, only on gasoline, a sleeve shut-off valve 83 is slidably mounted on metering pin 69 and has a shoulder 85 at its upper end overlying a horizontal terminal 87 of a vertical link 89 connected to a lever arm 91 fulcrumed at 93 on the mixture conduit wall and having its other arm 95 pivotally connected at 97 to an arm 99 on choke valve shaft 32. A spring 101 seated against the lower surface of horizontal terminal 87 on line 89 engages an upwardly facing shoulder 103 on sleeve valve 83 to bias the latter into seating engagement with orifice 43, whereby to close the latter whenever the choke valve is closed and thereby prevent passage of the methanol or other non-gasoline liquid into the associated nozzle 65.

Thus, while the choke valve is closed during cold starts and sleeve 83 seated against orifice element 43 to prevent the passage therethrough of the non-gasoline liquid, gasoline from chamber 37 is available to the intake conduit either through constantly open orifice 41, passage 57 and gasoline nozzle 59 or through orifice 41, passages 57, 68, 66 and 62 and idling ports 64, for cold starts and idling.

Figure 5:
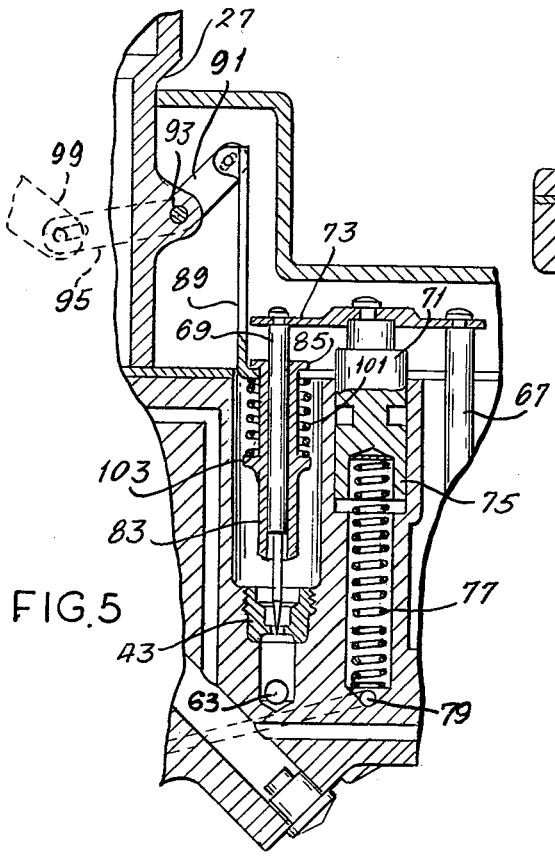
FIG. 5 is a fragmentary vertical sectional view corresponding to a portion of FIG. 4 showing the position of the non-gasoline liquid metering pin with both the choke and throttle valves opened.
Figure 6:
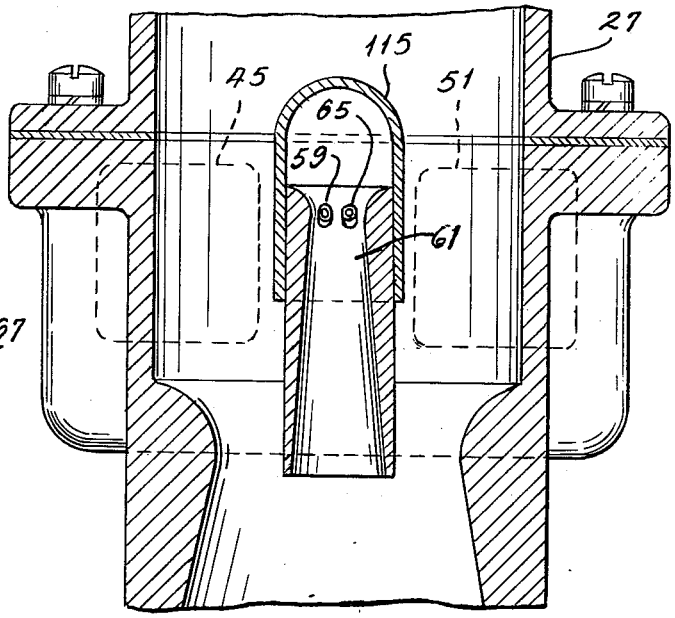
FIG. 6 is a fragmentary vertical sectional view taken along line 6—6 of FIG. 4.
Figure 7:
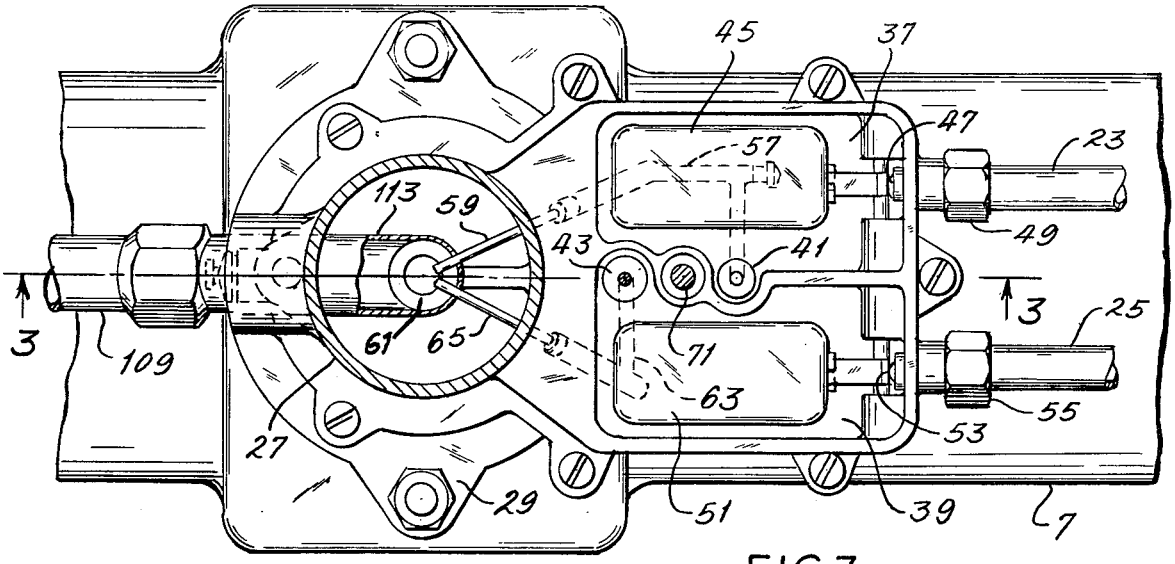
FIGS. 7 and 8 are horizontal sectional views taken along lines 7—7 and 8—8 respectively of FIG. 2.
Figure 8:
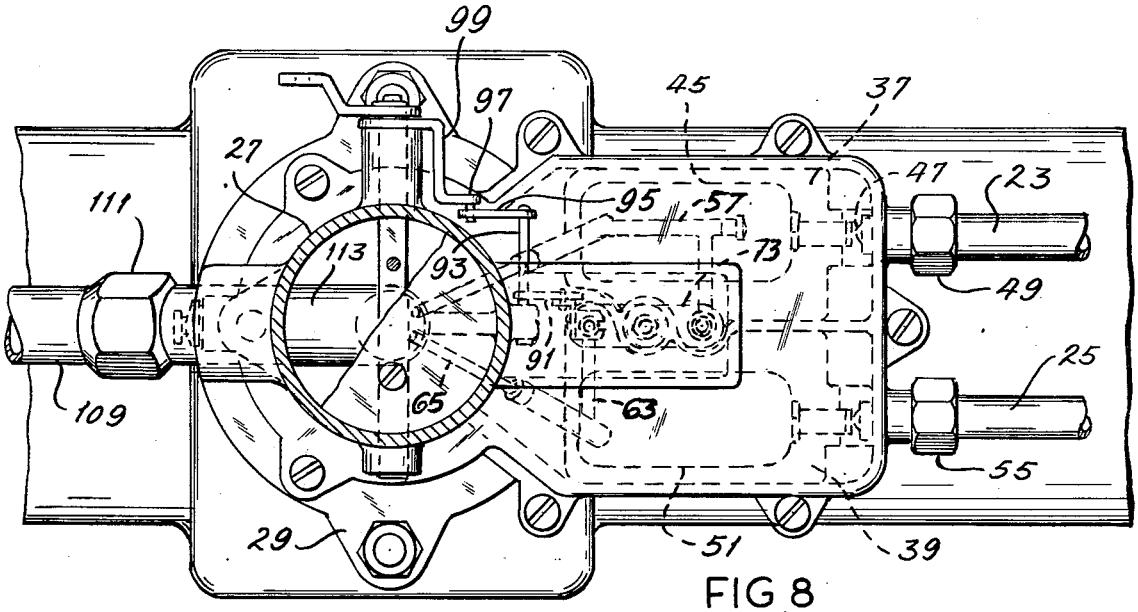

With this arrangement, when the choke valve opens, arm 99 on choke valve shaft 32 will rotate clockwise causing counterclockwise rotation of lever 91, 93, 95 and elevation of link 89 with corresponding elevation of sleeve valve 83 to open orifice element 43, as seen in FIG. 5. Thus, when the choke valve is opened and manifold vacuum is reduced below its idling valve, both gasoline from chamber 37 and methanol or other non-gasoline liquid from chamber 39 will be metered through orifice elements 41 and 43 into the respective nozzles 59 and 65, from which both liquids will be introduced into the intake conduit at the throat of the primary Venturi above the level of the liquid in chambers 37 and 39 and mixed therein.

To achieve vaporization and thereby facilitate the mixture of the two liquids in the primary Venturi, air is transmitted from air cleaner 15 via tube 105 to a straight thin wall heat exchange tube 107 extending substantially the full length of the exhaust manifold 9 and connected at the opposite end thereof to a tube 109 secured by a fitting 111 to a short tubular conduit 113 extending through the wall of the mixture conduit and bent downwardly at 115 to communicate directly with primary Venturi 61. This arrangement will provide air at temperatures substantially higher than the end point of the gasoline, preferably 400°–1200° F., thus effecting vaporization of the gasoline and other liquid by this high temperature in the primary Venturi without unduly heating the entire air supply to the engine.

Figure 9:
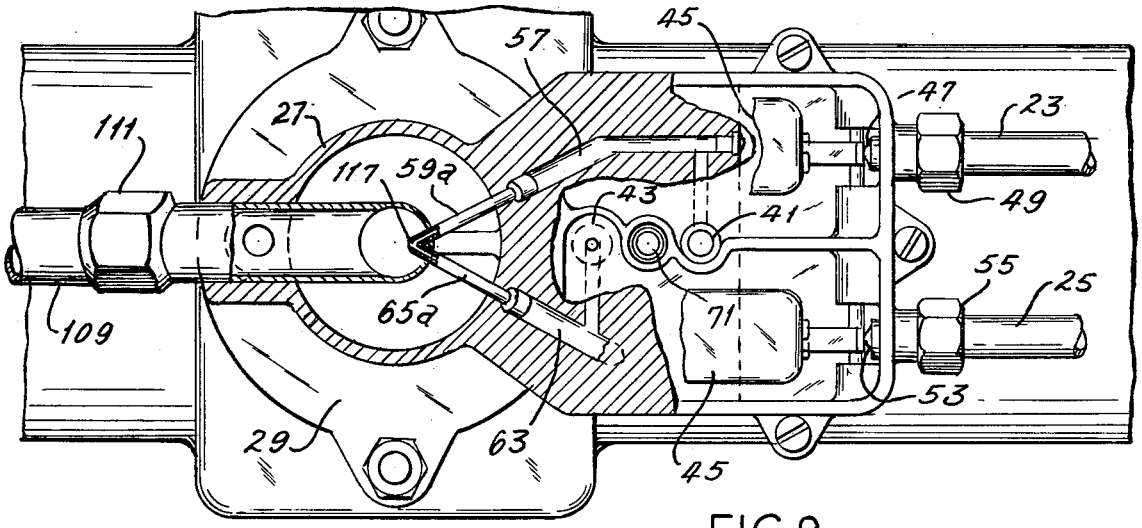
FIG. 9 is a horizontal sectional view taken principally along line 9—9 of FIG. 3 but showing a modified form of the invention.

In the embodiment of the invention illustrated in FIG. 9, the nozzles **59*a* and 65*a* intersect each other in primary Venturi 61 at a slightly higher level than the liquid level in chambers 37 and 39 and are formed with a downwardly directed opening 117 for directing the two liquids downwardly into the primary Venturi, where they are vaporized by hot air from tubular conduit 113.**

Operation of the invention is as follows: During cold starts, when choke valve 31 is closed, i.e., in the position seen best in FIG. 4, arm 99 on choke valve shaft 32 is in the position shown therein in which lever 95, 93, 91 maintains link 89 with its horizontal terminal 87 in the lowermost position such that spring 101 seated against shoulder 87 urges sleeve valve 83 into seated engagement with outlet orifice 43, thereby preventing any of the non-gasoline liquid in chamber 39 from passing through orifice 43 into passageway 63 and via nozzle 65 into the intake conduit at the throat of primary Venturi 61 but gasoline passes through orifice 41 and the associated passageways into the intake conduit. During idling, with the throttle closed, gasoline passes through orifice element 41, passages 57, 68, 66 and 62 to the idling ports 64, but no non-gasoline liquid from chamber 39 passes into the intake conduit because idle passages 57, 68, 66 and 62 do not communicate with orifice element 43 of non-gasoline liquid chamber 39.

When the choke and throttle valves are open, as during normal operation, arm 99 on choke valve shaft 32 is rotated clockwise causing counterclockwise rotation of lever 95, 93, 91 and corresponding elevation of link 89, such that its horizontal terminal 87 engages enlarged head 85 on transverse sleeve 83 to raise the latter out of seating engagement with outlet orifice 43, thus permitting the non-gasoline liquid to flow from chamber 39 into passage 63 and through nozzle 65 into primary Venturi 61, where it is vaporized by hot air through tubular member 113 and is blended with the similarly vaporized gasoline discharged into the primary Venturi by nozzle 59. Upon closure of the choke valve for any reason, the linkage comprising choke valve shaft arm 99, lever 97, 93, 91 and link 89 will permit the sleeve to be urged by spring 101 into seated relation with outlet orifice 43, or upon closure of the throttle valve, the reduced vacuum in the Venturi will be insufficient to draw liquid through either of the nozzles, thus interrupting the flow of the non-gasoline liquid from fluid chamber 39 to the intake conduit and returning the engine to full gasoline operation.

The details of the construction may be varied substantially without departing from the spirit of the invention and the exclusive use of those modifications as come within the scope of the claims is contemplated.

I claim:

1. In a carburetor for an internal combustion engine, an intake conduit, a pair of separate liquid chambers each having an outlet below the normal liquid level therein, separate normally open metering valves respectively controlling said outlets responsive to fuel requirements of the engine, a shut-off valve separate from said metering valves controlling one of said outlets independently of the respective metering valve, means controlling said shut-off valve responsive to engine temperature to maintain said shut-off valve closed during cold starting of the engine when the engine temperature is below a predetermined value and to open said shut-off valve during normal operation of the engine when the engine temperature equals or exceeds such predetermined value, and separate passage means connecting said outlets to the intake conduit and having discharge means thereinto at a level above the liquid level in said chambers.

2. In a carburetor according to claim 1, a choke valve in the intake portion of said mixture conduit openable and closable in accordance with engine temperature, said shut-off valve control means being solely responsive to movements of said choke valve between closed and opened positions to maintain said shut-off valve closed whenever said choke valve is closed and to open said shut-off valve when said choke valve is opened.

3. In a carburetor according to claim 2 each said chamber outlet having a calibrated orifice and each said metering valve comprising a pin movable axially in the respective orifice, said shut-off valve being a sleeve slidably mounted on the associated metering pin, said shut-off valve control means comprising resilient means biasing said shut-off valve downwardly into seated sealing engagement with said one chamber outlet and a linkage connecting said shut-off valve to said choke valve and arranged to lift said shut-off valve out of seated sealing engagement with said one chamber outlet when said choke valve is moved from closed to opened position.

4. In a carburetor according to claim 3, said metering pins being operatively connected to each other for operation in unison.

5. In a carburetor according to claim 4, a cross bar connecting the upper ends of said metering pins, an upright cylinder formed in the fluid chamber wall structure, a plunger vertically slidably received in said cylinder and secured to said cross bar intermediate said metering pins, a spring biasing said plunger upwardly, and a vacuum connection between said cylinder and the intake conduit for operating said metering pins in accordance with suction conditions in said mixture conduit.

6. In a carburetor according to claim 5, a primary Venturi centrally disposed in said mixture conduit with its throat slightly above the liquid level in said fluid chambers, said passage means having their discharge ends in the throat of said primary Venturi.

7. In a carburetor according to claim 6, means for transmitting hot air from a source outwardly of the carburetor into the primary Venturi, whereby to effect vaporization of the liquids discharged into the Venturi through said separate passages.

8. In a carburetor according to claim 1, a throttle valve in said intake conduit posterior to said liquid discharge means, an idling port in said intake conduit posterior to said throttle valve, and additional passage means connecting said idling port solely to said other outlet whereby to provide communication during idling solely between said intake conduit and the liquid chamber served by said other outlet.

9. In combination with an internal combustion engine having an intake manifold and an exhaust manifold, an intake conduit communicating with said intake manifold, a pair of liquid chambers for storing respectively gasoline and a liquid other than gasoline, each of said chambers having an outlet below the normal liquid level therein, separate normally open metering valves respectively controlling said outlets responsive to fuel requirements of the engine, a shut-off valve separate from said metering valves controlling the outlet from the chamber containing liquid other than gasoline independently of the respective metering valve, means controlling said shut-off valve responsive to engine temperature to maintain said shut-off valve closed during cold starting of the engine when the engine temperature is below a predetermined value and to open said shut-off valve during normal operation of the engine when the engine temperature equals or exceeds such predetermined value, and separate passage means connecting said outlets to the intake conduit at a level above the liquid level in said chambers, a primary Venturi centrally disposed in said intake conduit and having its throat slightly above the liquid level in said chambers, said separate passage means terminating in said primary Venturi, a thin wall heat exchange tube extending lengthwise through the exhaust manifold substantially throughout the entire length thereof, and a hot air transmitting tube communicating directly with the upper end of said primary Venturi and connected at its opposite end to said thin wall tube, whereby to transmit hot air from said thin wall tube to said primary Venturi for effecting vaporization of the gasoline and other liquid discharged into the primary Venturi through said separate passages.

10. In combination with an internal combustion engine according to claim 9, an air cleaner mounted on the inlet end of said intake conduit and an air conduit connecting said air cleaner and the inlet end of said thin wall tube, whereby to provide clean air thereto.

* * * * *